US008794865B2

(12) United States Patent
Stadler

(10) Patent No.: US 8,794,865 B2
(45) Date of Patent: Aug. 5, 2014

(54) BOLLARD ASSEMBLY

(76) Inventor: David M. Stadler, Lathrup Village, MI (US)

( * ) Notice: Subject to any disclaimer, the term of this patent is extended or adjusted under 35 U.S.C. 154(b) by 1185 days.

(21) Appl. No.: 11/880,758

(22) Filed: Jul. 23, 2007

(65) Prior Publication Data

US 2008/0038057 A1 Feb. 14, 2008

Related U.S. Application Data

(60) Provisional application No. 60/832,781, filed on Jul. 24, 2006.

(51) Int. Cl.
*E01F 13/04* (2006.01)

(52) U.S. Cl.
CPC ..... *E01F 13/046* (2013.01)
USPC ..... 404/6

(58) Field of Classification Search
CPC ..... E01F 13/046
USPC ..... 184/6.17, 6.18; 404/6, 9, 10, 11; 49/49, 49/131
See application file for complete search history.

(56) References Cited

U.S. PATENT DOCUMENTS

| | | | | |
|---|---|---|---|---|
| 3,771,488 | A | 11/1973 | Ecke | 114/218 |
| 4,576,508 | A | 3/1986 | Dickinson | 404/6 |
| 4,635,492 | A | 1/1987 | Uebelhart | 74/89.15 |
| 4,715,742 | A | 12/1987 | Dickinson | 404/6 |
| 5,462,384 | A | 10/1995 | Arlandis | 404/6 |
| 5,597,262 | A | 1/1997 | Beavers et al. | 404/6 |
| 5,911,363 | A | 6/1999 | Oligschlaeger | 239/11 |
| 6,099,200 | A * | 8/2000 | Pepe et al. | 404/6 |
| 6,345,930 | B1 | 2/2002 | Mohassel | 404/9 |
| 6,626,606 | B1 | 9/2003 | Johnson | 404/6 |
| 6,805,515 | B2 | 10/2004 | Reale | 404/11 |
| 6,848,856 | B2 | 2/2005 | Johnson | 404/6 |
| 6,988,980 | B2 | 1/2006 | Moss | 494/15 |
| 6,997,638 | B2 | 2/2006 | Henslley et al. | 404/6 |
| 7,052,201 | B2 * | 5/2006 | Zivkovic | 404/11 |
| 7,101,112 | B2 * | 9/2006 | Burns et al. | |
| 7,244,075 | B2 * | 7/2007 | Stadler | 404/6 |

(Continued)

FOREIGN PATENT DOCUMENTS

WO WO2006027371 A2 * 3/2006 ..... E01F 13/00

OTHER PUBLICATIONS

PCT Written Opinion, PCT/US07/16713, dated Aug. 25, 2008.

*Primary Examiner* — William E Dondero
*Assistant Examiner* — Robert T Reese
(74) *Attorney, Agent, or Firm* — L.C. Begin & Associates, PLLC

(57) ABSTRACT

A telescoping bollard assembly is provided. The bollard assembly includes a threaded shaft and a shaft housing structure containing a lubricant source in fluid communication with the shaft threads. A lubricant is positioned in the lubricant source in contact with the threaded portion of the shaft. A funnel portion is in fluid communication with the lubricant source, and a shaft guide portion is in fluid communication with the funnel portion. A portion of the shaft projects to an exterior of the housing through a shaft exit portion. The shaft exit portion is in fluid communication with the shaft guide portion and defines a flow path for the lubricant to the lubricant source. Rotation of the shaft urges lubricant from the lubricant source sequentially into the funnel portion, the shaft guide portion, and the shaft exit portion, whereby the lubricant is returned to the lubricant source.

4 Claims, 12 Drawing Sheets

(56) References Cited

U.S. PATENT DOCUMENTS

| | | | | |
|---|---|---|---|---|
| 7,481,599 | B2 * | 1/2009 | Stice | 404/6 |
| 7,568,857 | B2 * | 8/2009 | Riotto | |
| 7,717,641 | B2 * | 5/2010 | Stice | 404/73 |
| 2005/0031411 | A1 * | 2/2005 | Hensley | 404/11 |
| 2006/0204327 | A1 | 9/2006 | Phelan | 404/6 |
| 2007/0258762 | A1 | 11/2007 | Stice | 404/6 |

* cited by examiner

FIG - 6
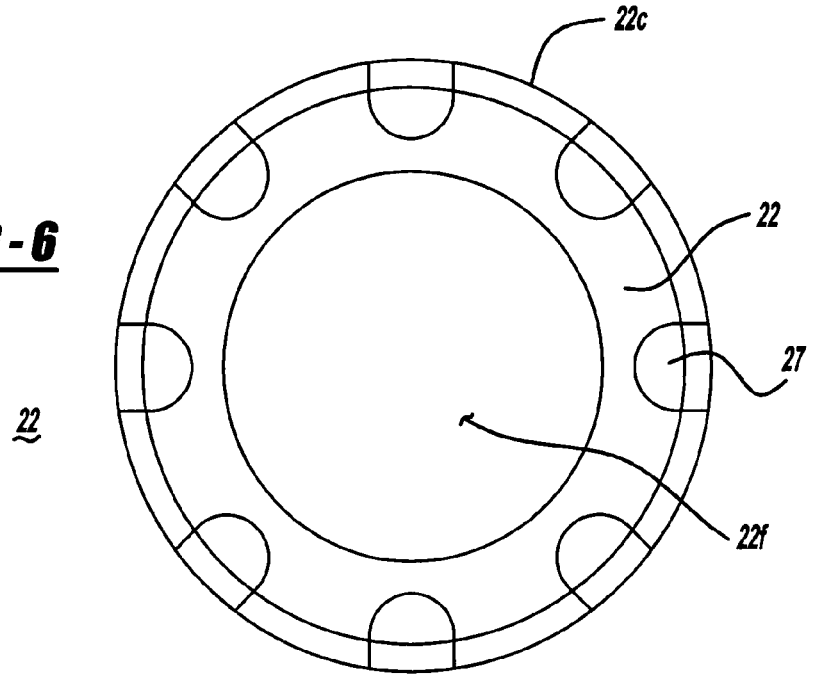
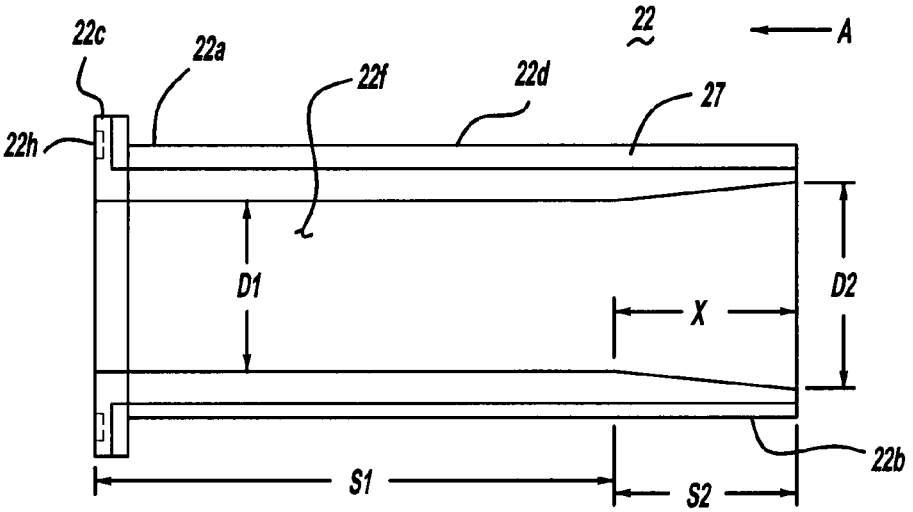
FIG - 7

BOLLARD ASSEMBLY

CROSS-REFERENCE TO RELATED APPLICATIONS

The present application claims the benefit of U.S. Provisional Application Ser. No. 60/832,781, filed on Jul. 24, 2006.

BACKGROUND OF THE INVENTION

A bollard is typically employed to prevent vehicular traffic inward or past the point of the bollard. Accordingly, any building or structure that requires protection may be protected by a plurality of bollards deployed about the periphery thereof. From a design standpoint, bollards must be strong enough to prevent and/or substantially slow movement of a vehicle between the bollard and the structure to be protected. Furthermore, periodically, vehicular access is desired and therefore the bollards must be designed in retractable fashion, thereby permitting vehicular travel over the recessed bollard.

Several retractable bollard designs are known and employ various deployment methods including hydraulic or pressurized gas means. Hydraulic bollards are disadvantaged by seals that sometimes deteriorate and result in a loss of hydraulic fluid pressure. On the other hand, bollards supported by gaseous pressure are disadvantaged by the loss of volume sometimes exhibited as ambient temperatures decrease. As with a loss of hydraulic pressure, the efficacy of the bollard comes into question as the supporting fluidic pressure is reduced. Furthermore, retractable bollards that function based on fluidic pressure must be maintained to ensure operability over extended periods of time.

SUMMARY OF THE INVENTION

In one aspect, a bollard assembly in accordance with the present invention includes a shaft assembly comprising a shaft having a plurality of threads formed therealong, and a shaft housing structure including a lubricant source in fluid communication with a threaded portion of the shaft. A lubricant is positioned in the lubricant source in contact with the threaded portion of the shaft, and a funnel portion is in fluid communication with the lubricant source. A shaft guide portion is in fluid communication with the funnel portion, and a shaft exit portion is provided through which a portion of the shaft projects to an exterior of the housing. The shaft exit portion is in fluid communication with the shaft guide portion, and the shaft exit portion defines a flow path for the lubricant to the lubricant source, wherein rotation of the shaft urges lubricant from the lubricant source sequentially into the funnel portion, the shaft guide portion, and the shaft exit portion, whereby the lubricant is returned to the lubricant source.

In another aspect, a bollard assembly in accordance with the present invention includes a valve assembly having a valve body and a valve assembly portion coupled to the valve body. The valve assembly portion has an orifice formed therein. A spring-actuated closure member is positioned within the valve body for engaging the valve assembly portion orifice to obstruct flow of a fluid through the valve body when a pressure differential between an interior of the valve body and an exterior of the valve body is below a predetermined value.

In yet another aspect, a bollard assembly in accordance with the present invention includes a housing, an outer bollard tube slidably positioned within the housing, and an inner bollard tube slidably positioned within the outer bollard tube, wherein a portion of the inner bollard tube overlaps a portion of the housing when the bollard assembly is fully extended.

In yet another aspect, a bollard assembly in accordance with the present invention includes a system for securing the bollard assembly. The system comprises a housing containing a member for actuating the bollard assembly, and a cap coupled to the housing and positioned to prevent access to the actuating member. A first securement member is coupled to the housing and is positioned to prevent repositioning of the cap, wherein repositioning of the first securement member permits repositioning of the cap so as to permit access the actuating member.

BRIEF DESCRIPTION OF THE DRAWINGS

In the drawings illustrating embodiments of the present invention:

FIGS. 6 and 7 show views of a shaft guide mountable in the bollard assembly shown in FIGS. 1 and 2.

DETAILED DESCRIPTION

Figure 1:
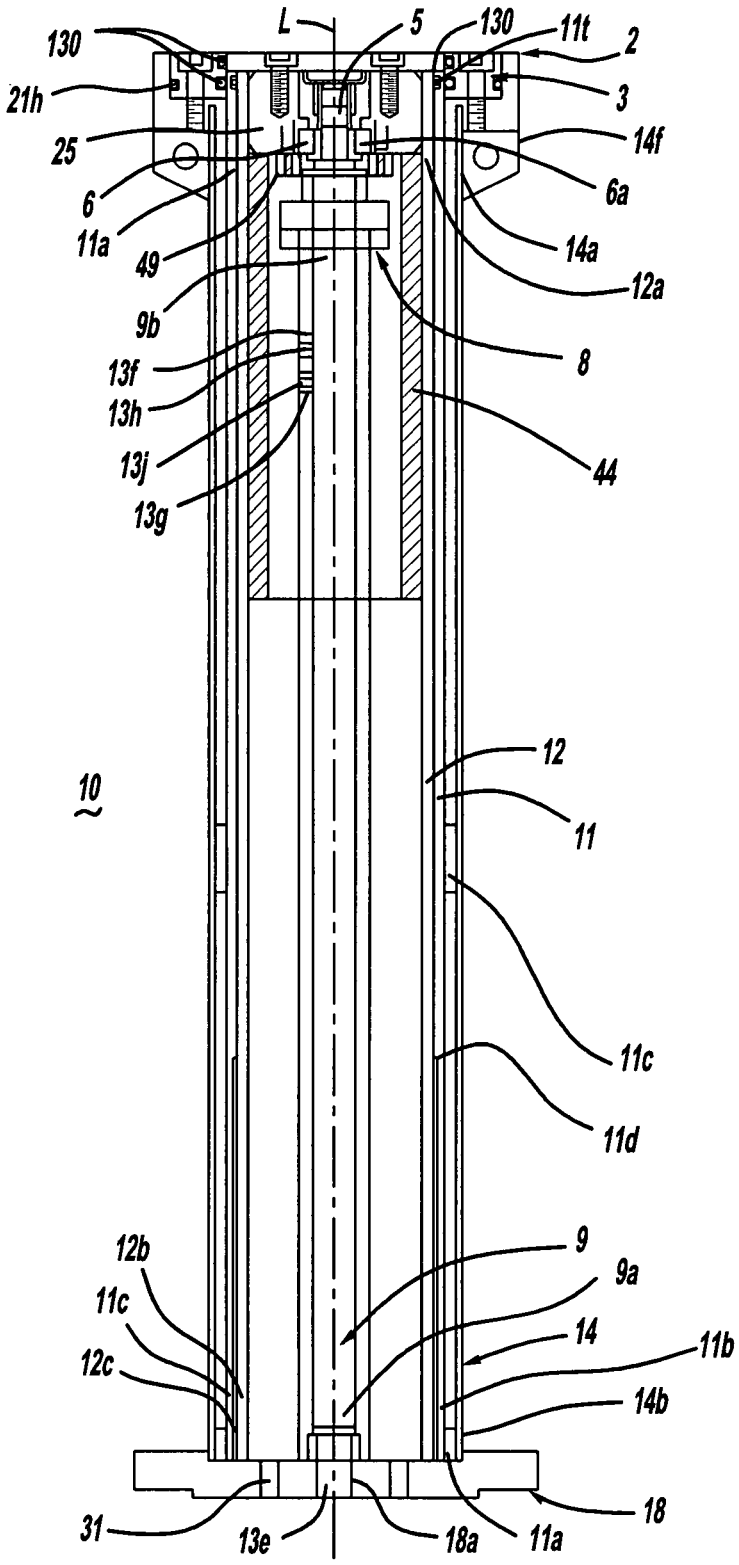
FIG. 1 shows a cross-sectional view of a bollard assembly in accordance with the present invention in a retracted state.
Figure 2:
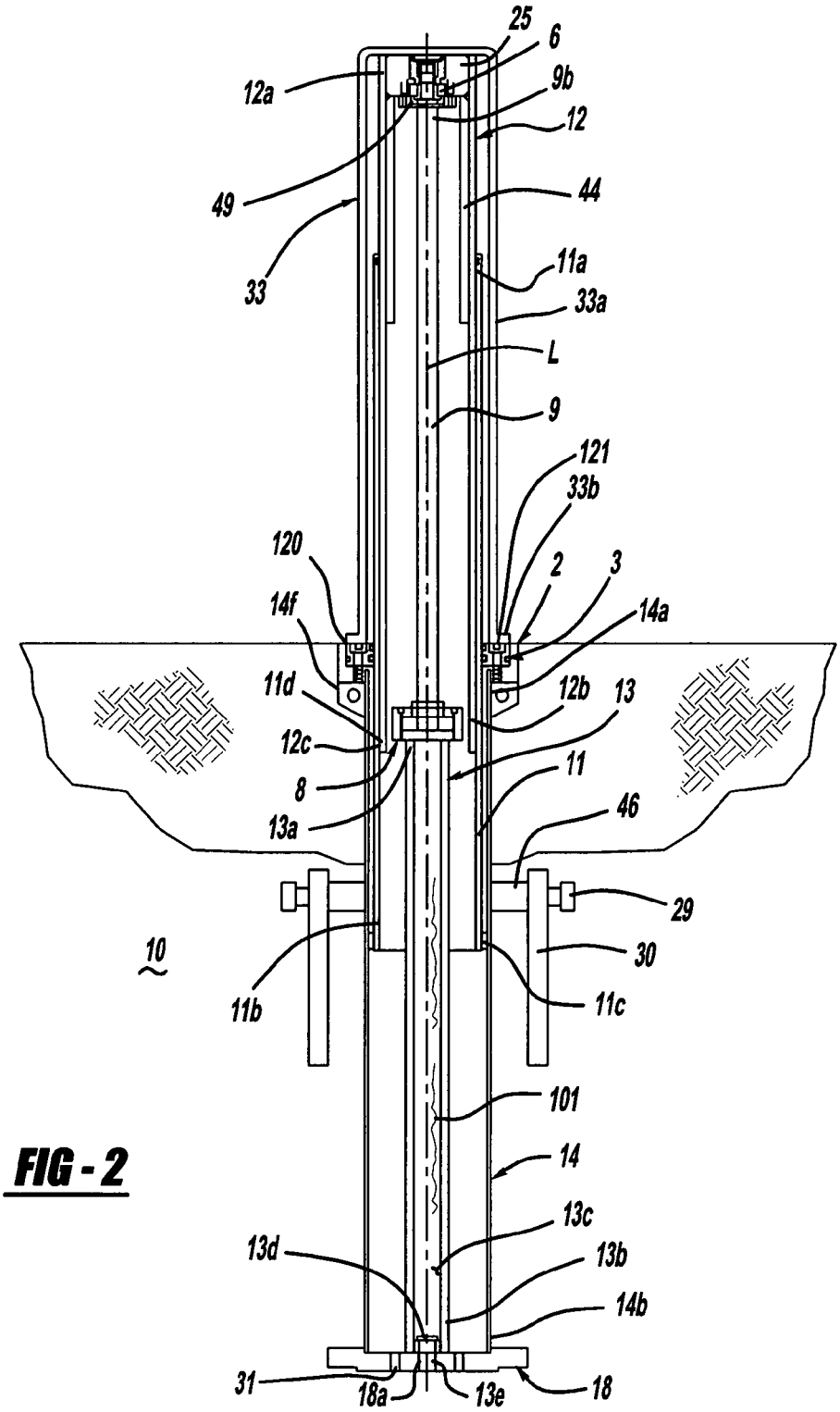
FIG. 2 shows a cross-sectional view of a bollard assembly in accordance with the present invention in a raised or actuated state.
Figure 4:
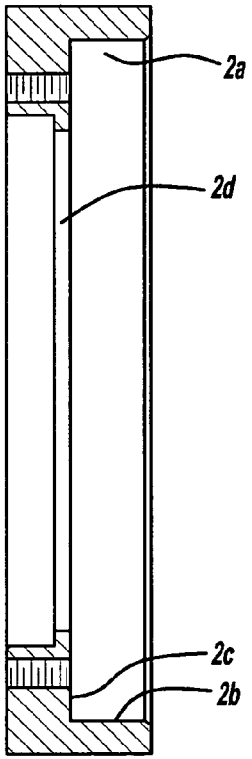
FIGS. 3 and 4 show views of a cup flange mountable in the bollard assembly shown in FIGS. 1 and 2.
Figure 3:
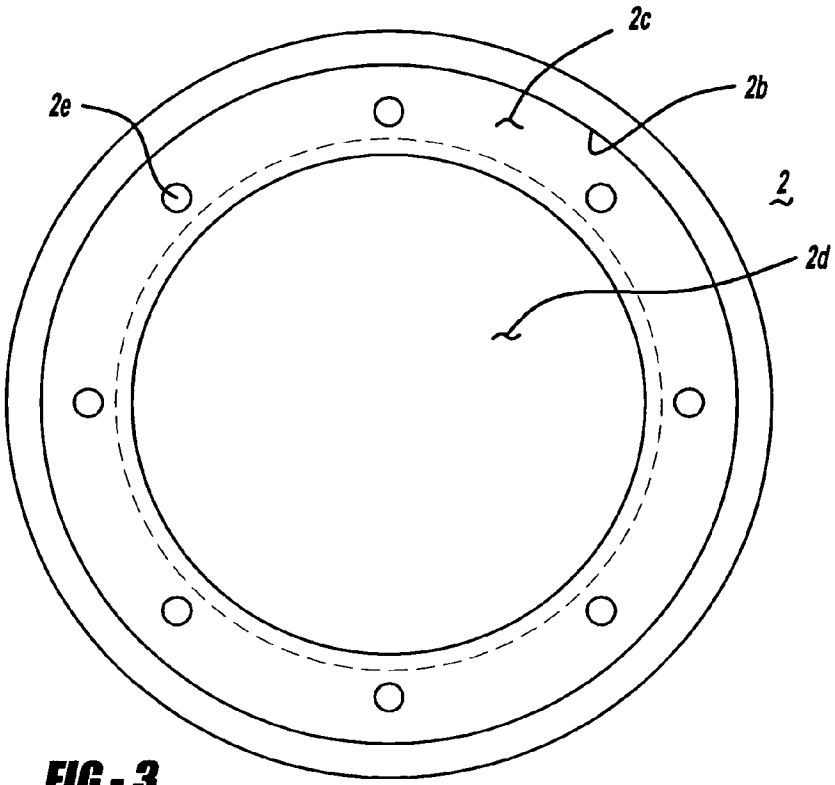

FIGS. 1 and 2 show cross-sectional views of a bollard assembly 10 in accordance with one embodiment of the present invention. As seen in FIGS. 1 and 2, bollard assembly 10 includes is retractable and operable on a screw drive shaft 9. Bollard assembly 10 also includes a base flange 18 and a bollard housing 14 secured to the base flange for mounting of the other bollard assembly components therein. Most components of the bollard assembly may be nitride coated using known processes for maximum corrosion protection and wear resistance. After nitride coating of a component, an auto ferritic may be applied by any suitable vendor (for example, Henkels & McCoy of Blue Bell, Pa.) to enhance corrosion resistance.

Housing 14 has a first end 14*a* and a second end 14*b*. Housing 14 is formed from steel plate which is rolled into a cylinder having a longitudinal axis L, and welded along a seam. The basic steel tube from which housing 14 is formed can be fabricated by any suitable vendor, for example Defasco, Inc. Additional features may be finish machined onto the tube as desired for a particular application.

Anchoring the bollard housing 14 is achieved in a known manner, by excavating a suitable space in the ground to enable the bollard assembly to be inserted to a point where an uppermost surface of cup flange 2 resides at approximately ground level. As shown in FIG. 2, anchor bolts 29 may be provided to affix perforated anchor flanges 30 (or other protrusions suitable for providing a bearing surfaces for poured cement) via coupler sleeves 46 welded to housing 14. Anchor flanges 30 have holes and serrations to allow greater anchoring area for encapsulation by liquid cement poured into the anchoring hole to enclose the below-ground portion of the bollard assembly.

Figure 13:
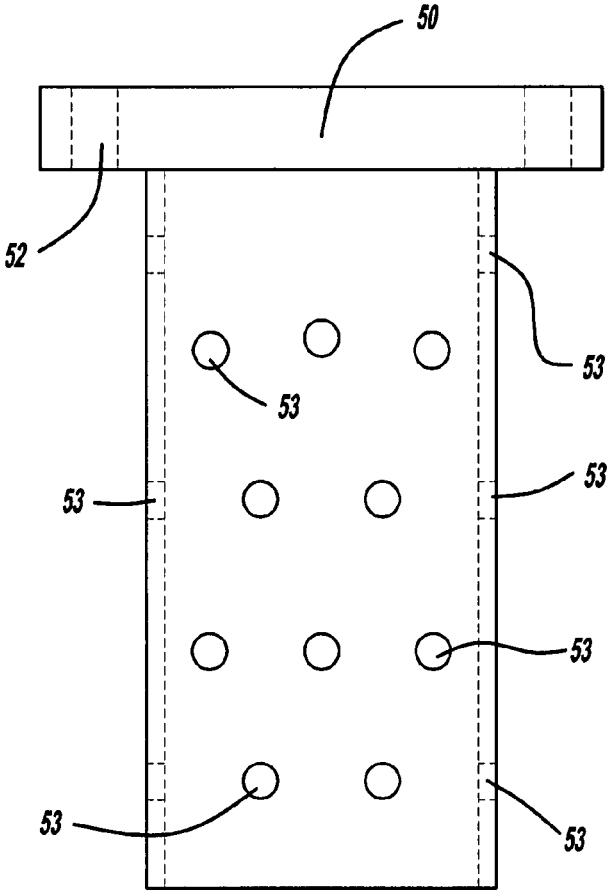
FIG. 13 shows a view of an extension housing mountable on the bollard assembly shown in FIGS. 1 and 2.

Referring to FIG. 13, for applications in which the bollard assembly is to be installed in ground having less than ideal soil conditions for securement of the bollard therein, an extension housing 51 may be bolted to base flange 18 via bolt bores 52 formed in an adapter flange 50. The overall length of extension housing 50 may be varied to provide additional mounting strength for the bollard assembly, according to the soil conditions and to the mounting and stability requirements of a particular application. Multiple perforations 53 formed in extension housing 51 allow liquid cement to fill the inside and around the outside of the extension housing to provide additional strength and stability to the bollard assembly mounting.

Bollard housing base flange 18 is welded or otherwise fixed to the housing second end 14*b* thereby providing a support base for the entire bollard assembly 10. A threaded hole 18*a* is provided in flange 18 for receiving therein a complimentarily threaded stud 13e affixed to a stanchion 13 (described in greater detail below). If desired, the housing base flange 18 may include one or more orifices 31 for drainage of any moisture that accumulates within housing 14. Base flange 18 is formed from steel or another suitable metal or metal alloy using known methods.

As shown in the Figures, one or more lifting ears 14*f* may be welded or otherwise fixed to bollard housing 14, thereby facilitating movement of the bollard assembly 10 by attachment to one or more of the lifting ears.

Referring to FIGS. 1-4, a cup flange 2 is welded or otherwise suitably secured to housing first end 14*a*. Cup flange 2 has a counterbore 2*a* formed therein which defines a sidewall 2*b* and a floor 2*c*. A central through hole 2*d* is sized to permit passage of outer bollard tube 11 (described below) therethrough during actuation of the bollard assembly. A series of tapped holes 2*e* may be distributed along cup flange floor 2*c* to enable bolting of an access flange 3 (described below) thereto. Cup flange 2 is formed from steel using known methods.

Referring to FIGS. 1 and 2, stanchion 13 includes a steel cylindrical tube secured within housing 14. Stanchion 13 has a first end 13*a*, a second end 13*b* opposite the first end, and an internal bore 13*c* extending through the length of the tube. A floor 13*d* is welded or otherwise secured to end 13*b*. Floor 13*b* has a stud 13*e* affixed therein and extending from an outside face thereof to enable engagement with complementary threads formed in threaded hole 18*a* of base flange 18. The diameter of stanchion bore 13*c* is sized to house a shaft guide 22 enclosing a portion of threaded shaft 9, which is used to extend and retract bollard assembly 10 in a manner described in greater detail below. Floor 13*b* is secured to the stanchion tube so as to provide a sealed enclosure for containing therein a lubricant 101 used to lubricate shaft 9 during extension and retraction of the bollard assembly. Thus, the stanchion enclosure serves as a reservoir for the lubricant. In general, lubricant 101 may occupy a sufficient portion of the stanchion internal volume so as to immerse shaft 9 in lubricant along anywhere from ½ up to ⅔ of the length of the shaft, depending on the lubricant and the particular application. Lubricant 101 may have any viscosity, composition, or other properties suitable for lubricating drive shaft 9 under the given environmental conditions in which the bollard will operate.

Figure 5:
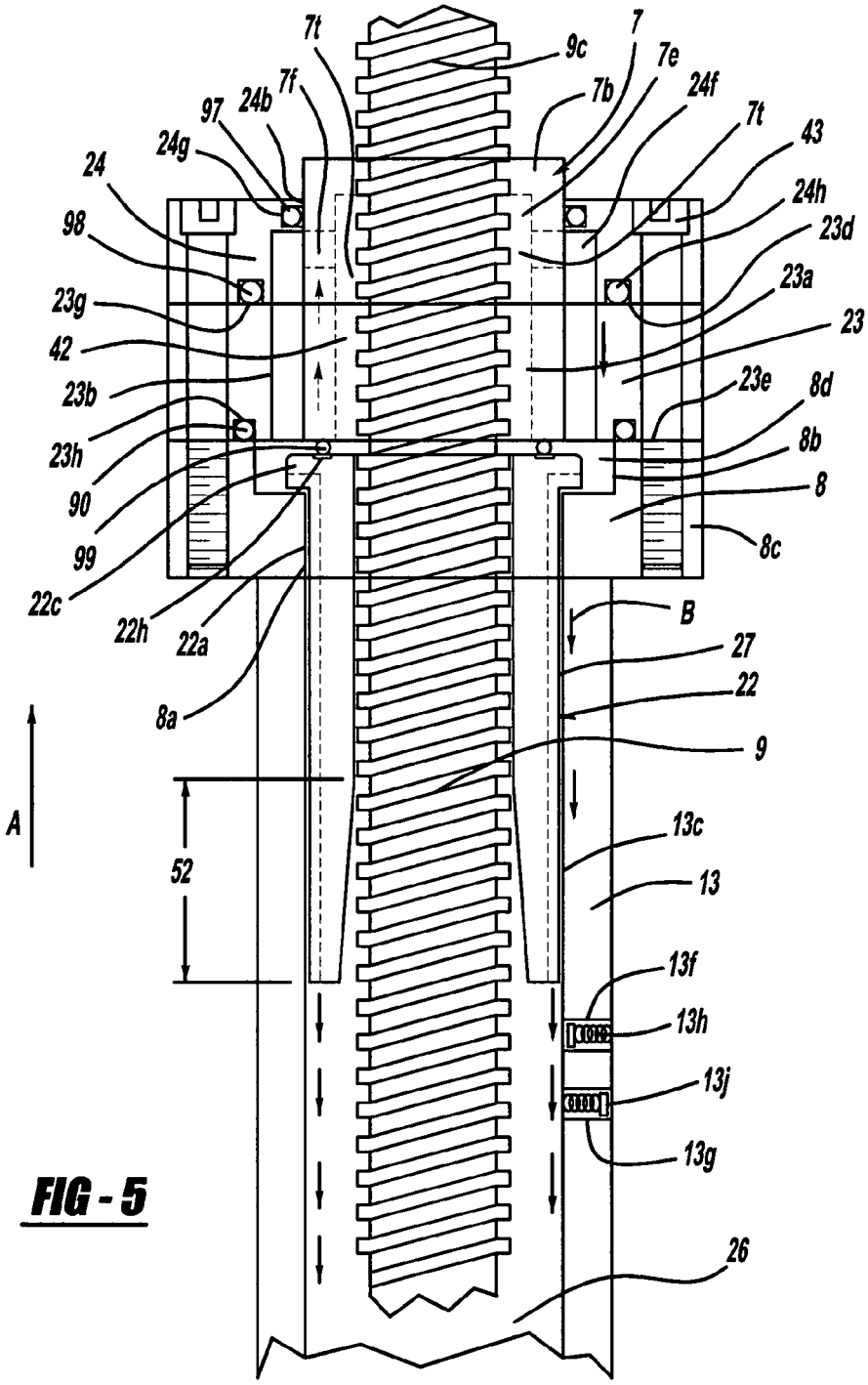
FIG. 5 shows a cross-sectional view of a shaft assembly including a lubricant circulation system mounted in the bollard assembly shown in FIGS. 1 and 2.

Stanchion 13 is secured to base flange 18 by screwing stud 13*e* into hole 18*a*. Alternatively, stanchion 13 may be welded to base flange 18 prior to attachment of housing 14 to the base flange. Referring to FIG. 5, stanchion 13 also includes openings 13*f* and 13*g* to enable the mounting of an inlet valve 13*h* and an outlet valve 13*j* therein. Valves 13*h* and 13*j* are shown schematically in FIG. 5, and are configured to permit automatic flow of air into or out of stanchion 13, to equalize the pressure inside the stanchion with the pressure outside the stanchion during actuation of the bollard assembly. Valves 13*h* and 13*j* may be any type of valve (for example, poppet valves) suitable for performing the pressure equalization function.

Figure 15A:
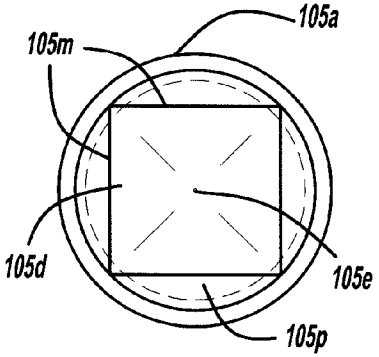
FIGS. 14 and 15A show views of valve assemblies mountable in the bollard assembly shown in FIGS. 1 and 2.
Figure 14:
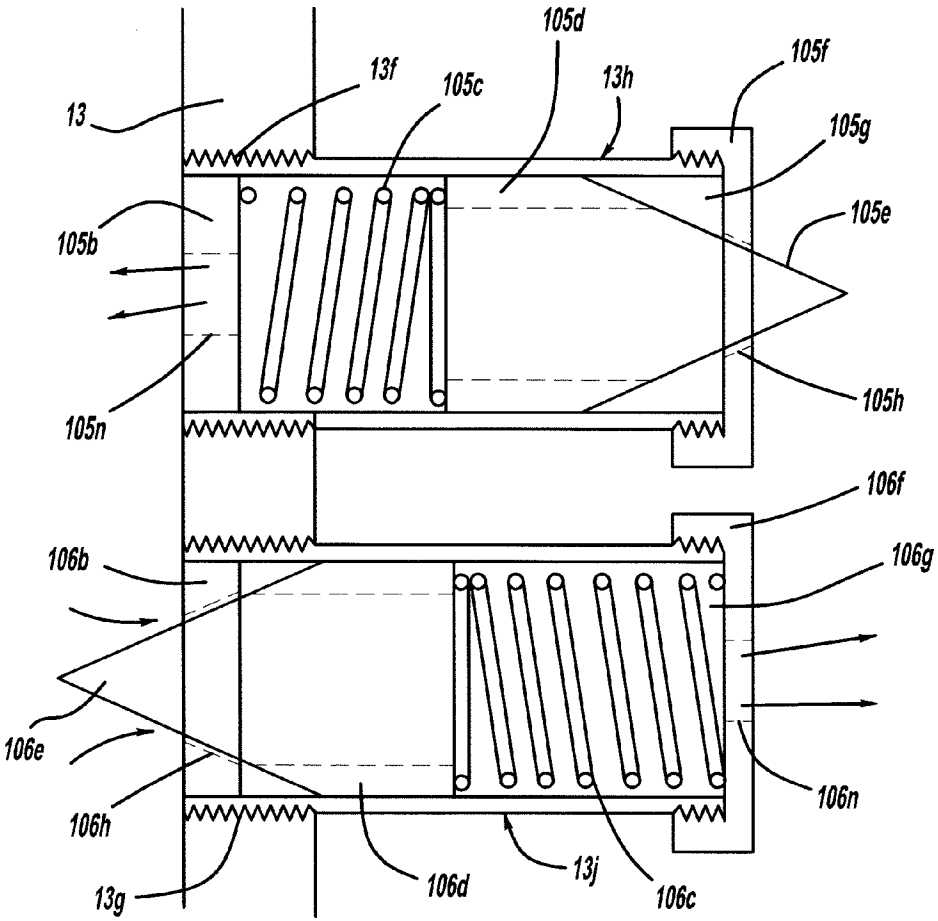
Figure 15B:
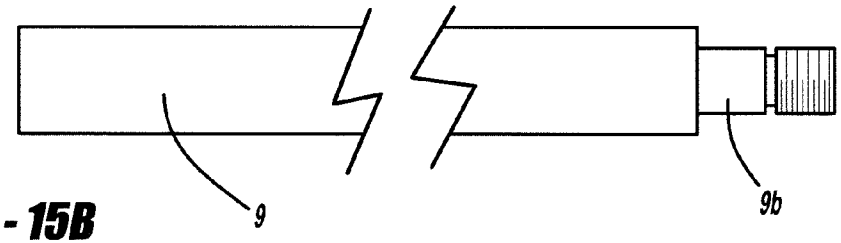
FIGS. 15B, 16, and 17 show views of a portion of a drive head assembly mountable in the bollard assembly shown in FIGS. 1 and 2.
Figure 16:
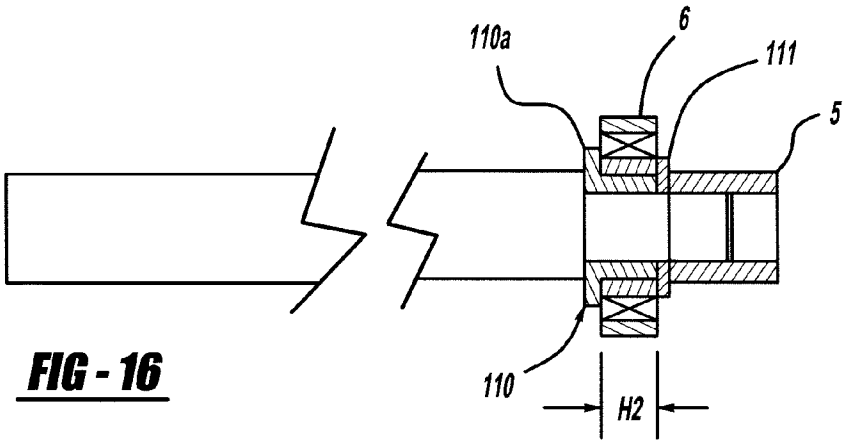
Figure 17:
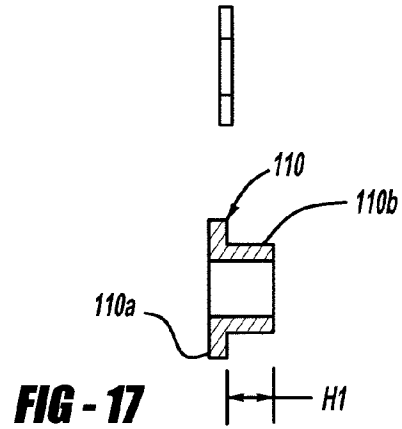
Figure 18:
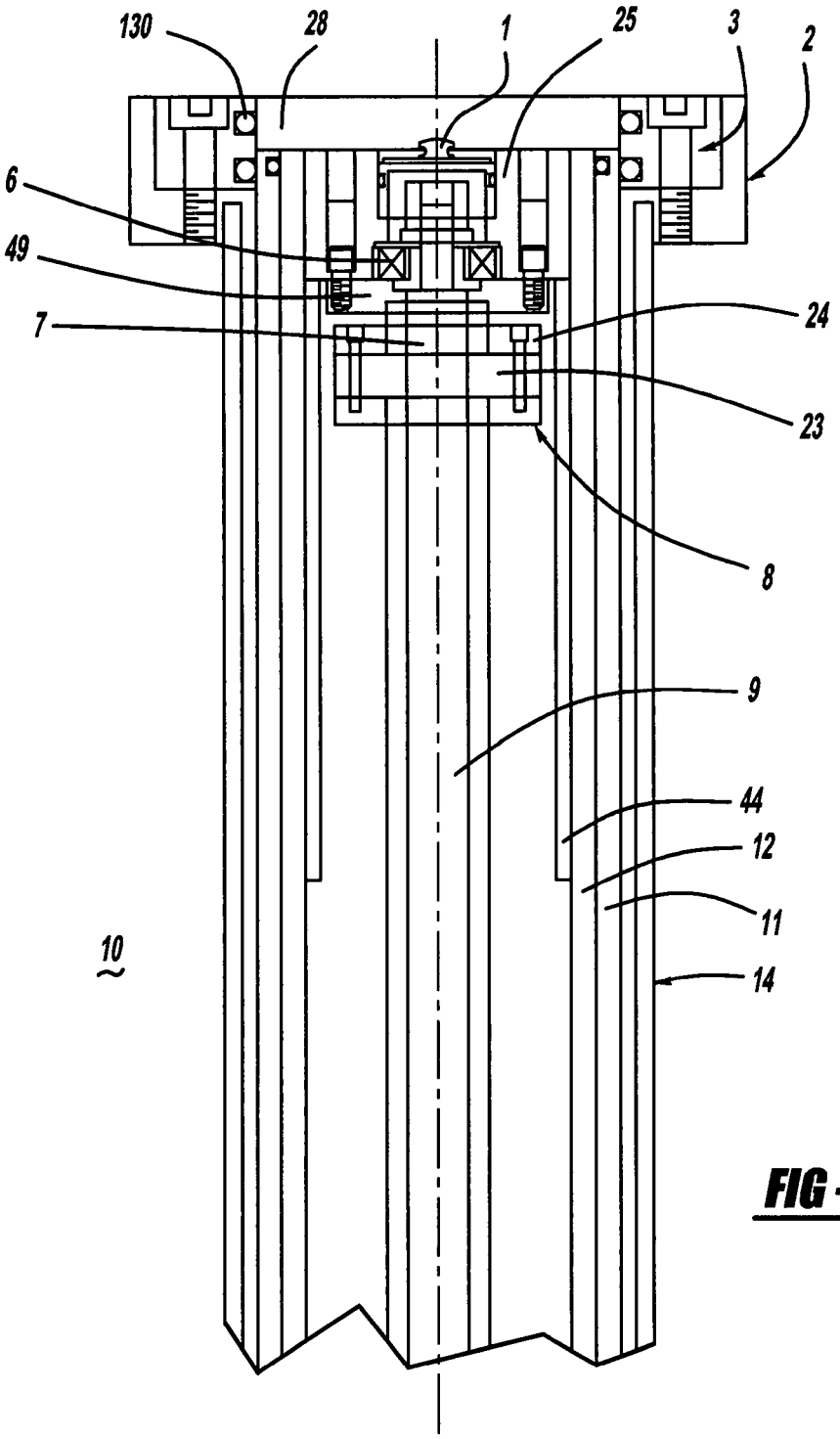
FIG. 18 shows a magnified cross-sectional view of a portion of the bollard assembly of FIG. 1.
Figure 19:
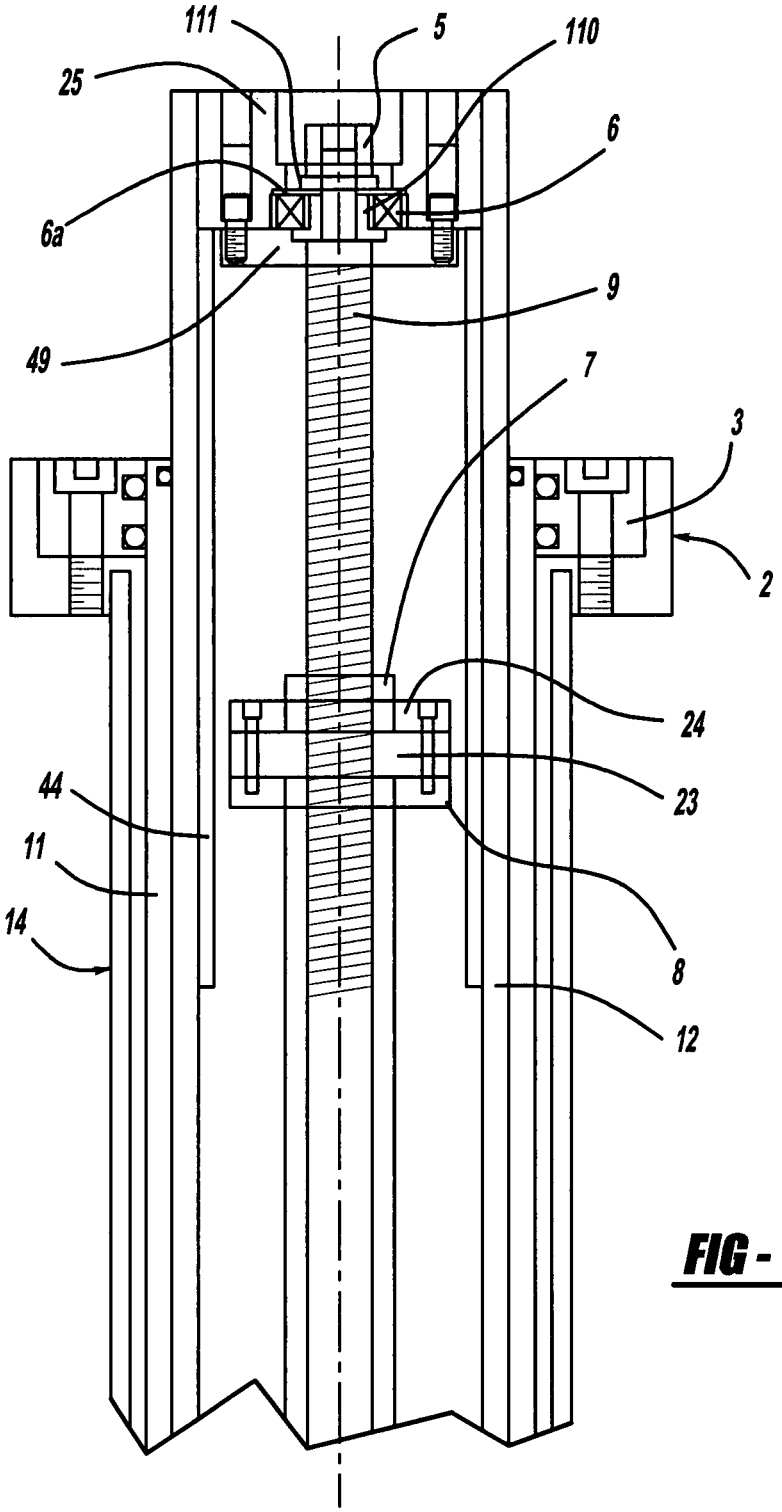
FIG. 19 shows a magnified cross-sectional view of a portion of the bollard assembly shown in FIG. 2, in a partially raised state.

A particular embodiment of valves 13*h* and 13*j* are shown in FIGS. 14 and 15A. A substantially cylindrical valve body 105*a* is formed from tubing made from steel, aluminum, or any other suitable material. Valve body 105*a* is press-fit or screwed into opening 13*f* formed in the wall of stanchion 13. An exit plate 105*b* is secured within a first end of valve body 105*a*. Exit plate 105*b* has a through orifice 105*n* formed therein to enable fluid communication between an interior of the valve body and an interior of stanchion 13. One end of a spring member 105*c* (such as a coil spring or any other suitable type of spring member) bears against exit plate 105*b*. Another end of spring 105*c* bears against a closure member 105*d*. Closure member 105*d* is formed from a piece of square stock (made from steel, aluminum, or any other suitable material) machined at one end to form a substantially conical tip 105*e*. A cap 105*f* (made from steel, aluminum, or any other suitable material) has a cavity 105*g* formed therein with an inner diameter sized to enable securement of the cap (via a threaded connection or a press-fit) over a free end of valve body 105*a*. Cap 105*f* has an opening 105*h* in the shape of a conical section corresponding to the conical shape of tip 105*e*. Opening 105*h* is configured to engage and abut tip 105*e* so as to close the opening when closure member 105 is urged against the opening by spring member 105*c*, thereby blocking a flow of air from the stanchion interior to an exterior of the stanchion through valve 13*h*.

During raising or expansion of the bollard assembly, displacement of the bollard assembly internal components will tend to reduce the pressure within the bollard assembly. Valve 13*h* permits air to enter the stanchion interior during bollard actuation, to provide a compensatory increase in bollard internal pressure. Referring to FIGS. 14 and 15A, as the bollard assembly internal pressure is reduced, the pressure differential between the interior and exterior of the bollard causes closure member 105*d* to displace toward the stanchion, thereby opening hole 105*h* and permitting a flow of air therethrough. As a body of closure member 105*d* is formed from square stock, this air flows through the gaps 105*p* between sides 105*m* of closure member 105*d* and the wall of valve body 105*a*, through the spring member 105*c*, and into stanchion 13 via orifice 105*n*. When the pressure differential diminishes to a certain value, the force exerted by spring member 105 overcomes the pressure force acting on tip 105*e*, thereby forcing the tip back into conical opening 105*h* to close the valve.

The structure and operation of valve 13*j* are substantially similar to that of valve 13*h*. However, valve 13*j* enables flow of air out of stanchion 13, rather than into the stanchion. A substantially cylindrical valve body 106*a* is formed from tubing made from steel, aluminum, or any other suitable material. Valve body 106*a* is press-fit or screwed into opening 13*g* formed in the wall of stanchion 13. A cap 106*f* (made from steel, aluminum, or any other suitable material) has a cavity 106*g* formed therein with an inner diameter sized to enable securement of the cap (via a threaded connection or a press-fit) over a free end of valve body 106*a*. Cap 106*f* has a through orifice 106*n* formed therein to enable fluid communication between an interior of the valve body and an interior of stanchion 13. One end of a spring member 106*c* (such as a coil spring or any other suitable type of spring member) bears against cap 106*f* Another end of spring 106*c* bears against a closure member 106*d*. Closure member 106d is formed from a piece of square stock (made from steel, aluminum, or any other suitable material) machined at one end to form a substantially conical tip 106*e*. An entry plate 106*b* is secured within a first end of valve body 106*a*. Entry plate 106*b* has an opening 106*h* in the shape of a conical section corresponding to the conical shape of tip 106*e*. Opening 106*h* is configured to engage and abut tip 106*e* so as to close the opening when closure member 106 is urged against the opening by spring member 106*c*, thereby blocking a flow of air from the exterior of the stanchion interior to an interior of the stanchion through valve 13*j*.

During lowering or contraction of the bollard assembly, displacement of the bollard assembly internal components will tend to increase the pressure within the bollard assembly. Valve 13*j* permits air to exit the stanchion interior during bollard actuation, to provide a compensatory decrease in bollard internal pressure. Referring to FIGS. 14 and 15A, as the bollard assembly internal pressure increases, the pressure differential between the interior and exterior of the bollard causes closure member 106*d* to displace away from the stanchion, thereby opening hole 106*h* and permitting a flow of air therethrough. As a body of closure member 106*d* is formed from square stock, this air flows through the gaps between the sides of closure member 106*d* and the wall of valve body 106*a* (as described above), through the spring member 106*c*, and into stanchion 13 via orifice 106*n*. When the pressure differential diminishes to a certain value, the force exerted by spring member 106 overcomes the pressure force acting on tip 106*e*, thereby forcing the tip back into conical opening 106*h* to close the valve.

If desired, a suitable lubricant, coating, or surface treatment may be applied to closure members 105*d*, 106*d* and/or to the interior surfaces of valve bodies 105*a*, 106*a* to facilitate low-friction movement of the closure members within their respective valve bodies. In addition, as known in the art, spring members 105*c*, 106*c* may be specified so as to permit actuation of the closure members within any one of a variety of desired ranges of pressure differential.

Referring to FIGS. 1, 2, and 5, a stanchion flange 8 is welded or otherwise suitably secured to stanchion first end 13*a*. Flange 8 has a central through hole 8*a* and a counterbore 8*b* formed therein. Hole 8*a* and counterbore 8*b* are sized to receive therein a shaft guide 22 (described below). Flange 8 also has multiple tapped blind holes 8*c* formed therein for receiving complimentarily threaded ends of bolts (not shown) used for securing a threaded nut flange 23 (described below) and a lubricant flow director 24 (also described below) to flange 8. Stanchion flange 8 is formed from steel or another suitable metal or metal alloy, using known techniques.

Referring to FIGS. 5, 6, and 7, shaft guide 22 extends through stanchion flange hole 8*a* and into stanchion bore 13*c*. Shaft guide 22 has a first end 22*a*, a second end 22*b* opposite the first end, and an internal bore 22*f* extending through the length of the tube. Shaft guide 22 also includes a flange 22*c* at first end 22*a* and a body 22*d* extending below flange 22*c*. Shaft guide flange 22*c* has a dimension sized to exceed the diameter of stanchion bore 13*c* such that flange 22*c* rests in a well 8*d* is formed within the counterbore between flange 22*c* and a wall of the counterbore. A diameter D1 of a first portion S1 of shaft guide bore 22*f* is sized to enclose a portion of threaded shaft 9 in a slight clearance fit, thereby providing a shaft guide to aid in centering and bracing the shaft during rotation. A diameter of a second portion S2 of shaft guide bore 22*f* is designed to decrease from a first value D2 at second end 22*b*, to D1 at a predetermined distance X from the end of the shaft guide, as described in greater detail below. The portion S2 of the shaft guide bore has the effect of funneling or channeling lubricant into the threads of shaft 9 and into portion S1 of the guide bore, as the lubricant is pressed or urged in the direction indicated by arrow A, by action of the shaft threads during turning of the shaft as the bollard assembly is extended.

Referring to FIGS. 5, 6, and 7, shaft guide 22 also includes a plurality of lubricant return passages 27 formed into a portion of flange 22*c* and along an exterior surface of shaft guide body 22*d*. As seen in FIG. 5, when shaft guide 22 is installed within stanchion 13, return passages 27 are in fluid communication with the lubricant reservoir in stanchion 13. The passages 22*g* aid in directing a return flow of lubricant to the lubricant reservoir in stanchion 13, in a manner described in greater detail below, and as indicated by arrows B in FIG. 5 showing a return flow path of the lubricant. A groove 22*h* may be formed along an upper surface of flange 22*c* for accommodating an O-ring 99 (FIG. 5) or other compliant seal therein. Shaft guide 22 is generally cylindrical and is formed from steel or another suitable metal or metal alloy using known methods.

Referring to FIG. 5, threaded nut flange 23 is positioned atop stanchion flange 8 after the insertion of shaft guide 22 into the stanchion flange and stanchion bore 13*c*. Nut flange 23 has an upper surface 23*d*, a lower surface 23*e*, and a threaded bore 23*a* extending therethrough for threadedly receiving a threaded nut 7 (described below) therein. Nut flange 23 also has a plurality of lubricant return passages 23*b* formed therein to enable fluid communication between stanchion flange well 8*d* and another well 24*f* formed in lubricant flow director 24. A groove 23*g* may be formed along upper surface 23*d* of flange 23 for accommodating an O-ring 98 or other compliant seal therein. Similarly, a groove 23*h* may be formed along lower surface 23*e* for accommodating O-ring 90 or another compliant seal therein. When Threaded nut flange 23 is positioned atop stanchion flange 8 and bolted thereon, O-ring seal 99 and o-ring seal 90 positioned in nut flange groove 23*h* is compressed and acts to prevent migration of lubricant radially outwardly from shaft 9, between nut flange 23 and stanchion flange 8 and between nut flange 23 and shaft guide 22. Threaded nut flange 23 is formed from steel or another suitable metal or metal alloy using known methods.

Referring to FIG. 5, threaded nut 7 has an exterior threaded portion (not shown) adapted for engaging complementary threads (not shown) formed in nut flange bore 23*a*, and a flange portion 7*b* sized to bear against nut flange upper surface 23*d* when the threaded nut is fully screwed into nut flange 23. Threaded nut 7 also includes a threaded bore 7*c* which engages complementary threads formed along the exterior of shaft 9 to enable expansion and retraction of the bollard assembly, in a manner described in greater detail below. Thus, threaded nut 7 threadedly engages and supports shaft 9.

A pair of axially-extending lubricant flow passages 7*t* disposed approximately 180° apart is formed along threaded bore 7*c* adjacent shaft 9. In addition, one or more flow channels 7*f* extend radially outwardly from (and in fluid communication with) flow well 7*e* to enable fluid communication between well 7*e* and a well 24*f* formed in a cap 24 (described below) positioned and secured atop threaded nut flange 23. Threaded nut 7 is formed from steel or another suitable metal or metal alloy using known methods.

As seen in FIG. 5, a cap 24 is bolted atop threaded nut flange 23. Cap 24 has a cavity 24*f* formed therein, and a central bore 24*b* extending through the length of the cap. Cavity 24*f* defines a well for receiving therein a flow of lubricant from flow passages 7*f* formed in threaded nut 7, as previously described. Central bore 24*b* is dimensioned to provide a slight clearance fit with threaded nut 7 received therein. A groove 24*g* is formed along a surface 24*e* of the cap residing adjacent threaded nut 7 for accommodating O-ring 97 or another compliant seal therein. Also, a groove 24*h* may be formed along lower surface 23*e* for accommodating O-ring 98 or another compliant seal therein. When cap 24 is positioned atop threaded nut flange 23 and bolted thereon, O-ring seal 98 positioned in either nut flange groove 23*g* or cap groove 24*h* is compressed and acts to prevent migration of lubricant radially outwardly from shaft 9, between nut flange 23 and cap 24. Similarly, when cap 24 is positioned over threaded nut 7, O-ring 97 is compressed to provide a seal between the threaded nut and the cap, to prevent migration of lubricant from cavity 24*f* between the threaded nut and the cap. Cap 24 is formed from steel or another suitable metal or metal alloy using known methods.

Thus, as described herein, stanchion 13, stanchion flange 8, shaft guide 22, threaded nut flange 23, threaded nut 7, and cap 24 form a shaft housing structure that incorporates therein a circulation system for the shaft lubricant 101.

Referring to FIGS. 1, 2, 5, and 15B, threaded shaft 9 is threadedly engaged with and supported by threaded nut 7. The shaft extends from stanchion 13, passing through stanchion flange 8, threaded nut flange 23, and cap 24, and into the interiors of inner bollard tube 12 and outer bollard tube 11. Threaded Shaft 9 has a first end 9*a*, a threaded second end 9*b*, and a plurality of threads 9*c* formed therealong. Shaft first end 9*a* resides within stanchion 13. Shaft end 9*b* is rotatably coupled (in a manner described in greater detail below) to an end portion of inner bollard tube 12 such that rotation of the shaft causes shaft threads 9*c* to engage the complementary threads in threaded nut 7 (described below) so as to either extend or retract the bollard assembly, depending on the direction of shaft rotation. As is known in the art, the characteristics of threads 9*c* may be varied according to the needs of a particular application. For example, a relatively greater number of threads per unit length of the shaft may be formed along shaft 9 if it is desired to reduce the amount of torque required to rotate shaft 9 and actuate the bollard assembly. However, providing a greater number of threads per unit length may correspondingly increase the time required to actuate the bollard. Shaft 9 is formed from steel or another suitable metal or metal alloy using known methods.

Referring to FIGS. 1, 2, 15B, 16, and 17, a bushing 110 is pressed onto second shaft end 9*b*, and bearing 6 is pressed onto bushing 110 so that the bearing rests on a flange 110*a* of the bushing. A body 110*b* of bushing 110 is sized such that a length H1 (FIG. 17) of the bushing body slightly exceeds a depth H2 (FIG. 16) of the bearing. Bearing 6 provides a thrust surface 6*a* on an upper face of the bearing which bears against a drive head housing 25 (described below) affixed to inner bollard tube 12 to extend and retract the bollard assembly. Bearing 6 also permits rotation of shaft 9 with respect to thrust surface 6*a*.

A washer 111 is applied to shaft 9 over bearing 6. Washer 111 acts as a spacer between bearing 6 and bushing 110. Prior to application of drive nut 5, washer 111 is slightly spaced apart from bearing 6 due to the difference between bushing body length H1 and bearing depth H2.

Referring to FIGS. 1, 2, 15B, 16, and 17, a drive head or nut 5 is screwed onto the threaded end of shaft end 9*b*, over washer 111. Drive nut 5 is affixed to shaft second end 9*b* so as to enable rotation of the shaft by rotation of the drive nut. Drive nut 5 has a cavity formed therein with a periphery shaped to engage a proprietary tool head used for turning the drive nut and shaft 9 which is affixed thereto, thereby actuating the bollard assembly. To secure the drive nut to the shaft and to prevent rotation of the drive nut with respect to the shaft, a pin is inserted through a wall of the drive nut and into the portion of the shaft end enclosed by the drive nut. A suitable epoxy or adhesive is then applied to a contact interface between the drive nut and the shaft. In addition, when drive nut 5 is screwed onto the shaft, the drive nut is tightened such that the bearing 6 is compressed between washer 111 and bushing flange 110*a*, thereby closing the slight clearance gap between washer 111 and bearing 6, to more tightly secure the bearing between washer 111 and bushing flange 110*a*.

A bearing retainer plate 49 is affixed to an underside of drive head housing 25 for securing bearing 6 to drive head housing 25. Retainer plate 49 includes at least a pair of threaded holes for receiving therein complimentarily threaded portions of bolts 130 inserted in the drive head housing, as described below.

Figure 8:
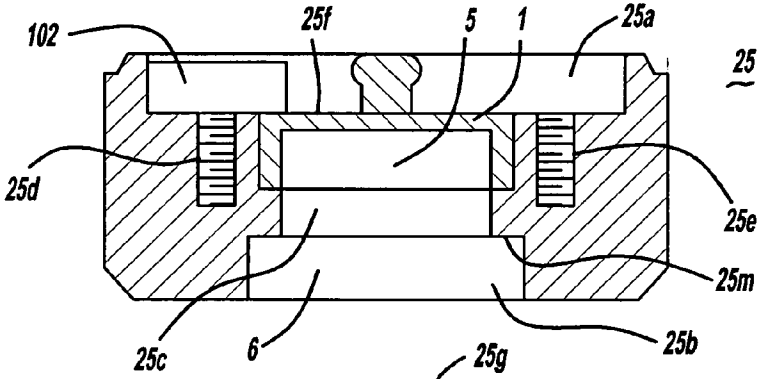
FIGS. 8, 9, and 9*a* show views of a drive head housing mountable in the bollard assembly shown in FIGS. 1 and 2.
Figure 9A:
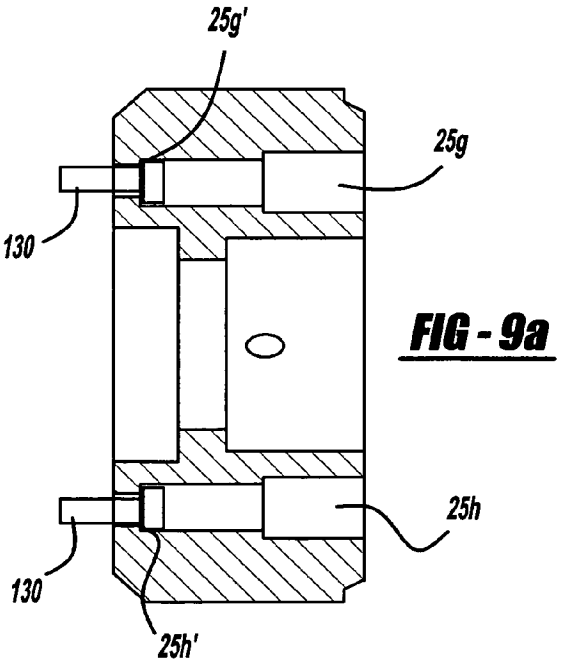
Figure 9:
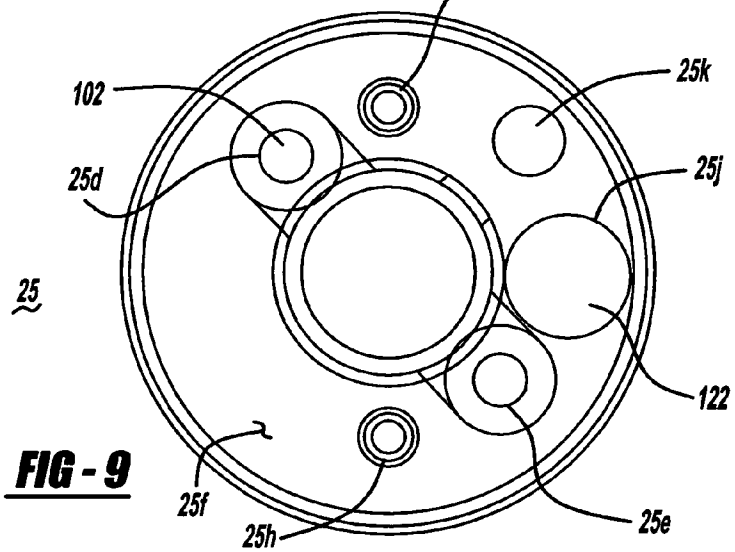

Referring to FIGS. 1, 2, 8, and 9, drive head housing 25 is sized to fit within an inner diameter of inner bollard tube 12 (described below) to enable welding of housing 25 to inner tube 12 within an upper end of the tube, as shown in FIGS. 8 and 9. Drive head housing 25 includes a first counterbore 25*a* formed in a first side of the housing, a second counterbore 25*b* formed in an opposite side of the housing, and a first through hole 25*c* extending between, and connecting, counterbores 25*a* and 25*b*. First counterbore has a floor 25*f* into which at least a pair of threaded holes 25*d*, 25*e* are formed. Second and third through holes 25*g* and 25*h* are provided to permit portions of a bollard disassembly tool (not shown) to be inserted into the drive head housing to engage the drive head housing, enabling lifting of the drive head housing, inner bollard tube 12, and the remaining portions of the bollard assembly attached thereto. This permits the components of the bollard assembly to be withdrawn from the bollard housing for servicing.

In addition, end portions 25*g*' and 25*h*' of holes 25*g* and 25*h*, respectively, are adapted to engage and support the heads of bolts 130 inserted into holes 25*g* and 25*h* from the side of the drive head housing into which first counterbore 25*a* is formed. Threaded ends of bolts 130 are threadedly received in complimentarily threaded holes formed in retainer plate 49, to secure the retainer plate to drive head housing 25.

A blind hole 25*j* provides a cavity for receiving therein a known radio frequency (RF) device 122 configured to emit a predetermined signal when the bollard assembly is damaged or tampered with. One or more vent holes 25*k* may also be formed in drive head housing 25 for venting air from the interior of the bollard assembly during actuation of the bollard assembly. Second counterbore 25*b* and first through hole 25*c* are configured for receiving therein portions of bearing 6 and drive head 5. A floor 25*m* of second counterbore 25*b* provides the bearing surface against which bearing 6 acts to enable extension of the bollard assembly using shaft 9, in a manner described in greater detail below. Through hole 25*c* provides access (through first counterbore 25*a*) to drive head 5, whereby an actuation tool can be applied to the drive head to rotate the drive head, thereby actuating the bollard assembly.

In one particular example, device 122 is self-contained and utilizes a sparse pulse methodology to transmit bollard assembly height changes on a real-time basis if there is tampering or any unauthorized access. Device 122 can also send notification of temperature, vibration, or other programmed data. Battery life is relatively long due to a transmission rate of only 5 pulses per minute. A transmission frequency band of 303 MHz to 450 MHz allows the emitted signal to be received up to a distance of 1200 ft. from the bollard assembly. The signal can then be recorded or boosted for further transmission. Each device 122 has a distinctive electronic "I.D." tag. Tampering with device 122 or with the bollard assembly is evidenced immediately upon cessation of signal transmission from the device. Device 122 may be positioned atop or exterior of a protective sleeve (described below) covering the bollard assembly if desired, to permit an unobstructed signal transmission.

Referring to FIGS. 1 and 2, outer bollard tube 11 has a first end 11*a* and a second end 11*b*. Outer tube 11 is formed from steel plate which is rolled into a cylinder having a longitudinal axis L, and welded along a seam. A shoulder 11*c* is machined along an outer surface of second end 11*b* intermediate first and second ends 11*a* and 11*b* to provide a positive stop which engages an inner diameter of access flange through bore 3*a* during extension of the bollard, to limit upward motion of the outer tube. Also, a shoulder 11*t* is machined along an outer surface of second end 11*b* to bear against an interior surface of housing 14 during actuation of the bollard assembly, to aid in centering and steadying the outer tube during movement within the housing. In addition, a shoulder 11*d* is machined along an interior surface of the outer tube, intermediate the first and second ends of the tube, to provide a positive stop which engages a complementary shoulder 12*a* formed along an exterior surface of inner bollard tube 12 (described below) during extension of the bollard to limit upward motion of inner tube 12, in a manner described in greater detail below. Shoulders 11*c* and 11*d* generally extend along a plane substantially perpendicular to axis L. The basic steel cylinder from which outer tube 11 is formed can be fabricated by any suitable vendor, for example Defasco, Inc. Additional features may be finish machined onto the tube as desired for a particular application.

Also, a groove 11*t* is formed along an interior surface of outer bollard tube first end 11*a* for accommodating a known hydraulic rod seal 130 or other compliant seal therein. Seal 130 engages an outer surface of inner bollard tube 12 as shown in FIG. 1 to provide a seal for preventing moisture from migrating into the bollard assembly interior between the inner and outer bollard tubes.

Referring to FIGS. 1 and 2, inner bollard tube 12 has a first end 12*a* and a second end 12*b*. First end 12*a* has drive head housing 25 inserted therein and welded of otherwise suitably secured in place. A shoulder 12*c* is machined along an outer surface of second end 12*b* to provide a positive stop which engages outer tube interior shoulder 11*d* during extension of the bollard, to limit upward motion of the inner tube, in a manner described in greater detail below. Shoulder 12*c* generally extends along a plane substantially perpendicular to axis L. Inner tube 12 is formed from steel plate which is rolled into a cylinder having a longitudinal axis L, and welded along a seam. The basic steel tube from which inner tube 12 is formed can be fabricated by any suitable vendor, for example Defasco, Inc. Additional features may be finish machined onto the tube as desired for a particular application.

Referring to FIGS. 1 and 2, an inner bollard reinforcement 44 is welded to an underside of drive head housing 25. As seen in FIGS. 1 and 2, reinforcement 44 is designed to extend downward from drive head housing_and to overlap a region where inner bollard tube 12 projects from outer bollard tube 11 when the bollard is extended. The reinforcement thus increases the effective thickness of the portion of inner tube 12 projecting from outer tube 1, thereby increasing the strength and impact resistance of this portion of the bollard assembly. Reinforcement 44 is formed from steel plate which is rolled into a cylinder having a longitudinal axis L, and welded along a seam. The basic steel tube from which reinforcement 44 is formed can be fabricated by any suitable vendor, for example Defasco, Inc. Additional features may be finish machined onto the tube as desired for a particular application.

Figure 11:
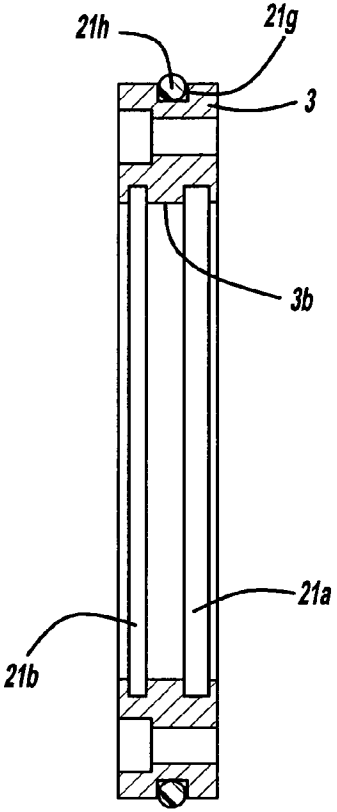
FIGS. 10 and 11 show views of an access flange mountable in the bollard assembly shown in FIGS. 1 and 2.
Figure 10:
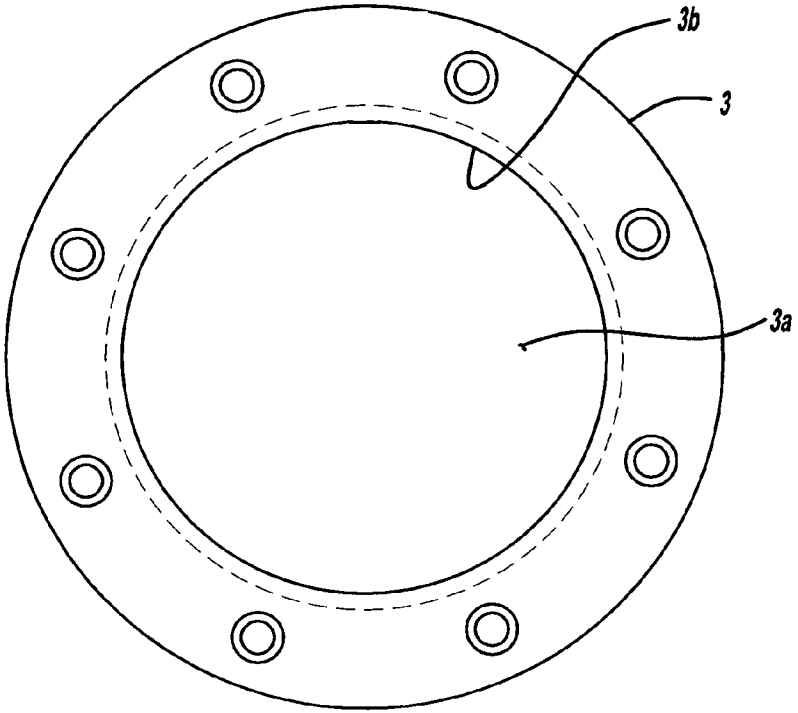

Referring to FIGS. 1, 10, and 11, an access flange 3 is positioned and bolted or otherwise secured within cup flange counterbore 2*a*. Access flange 3 has a through bore 3*a* defined by a wall 3*b*. Bore 3*a* is sized to permit passage of outer bollard tube 11 therethrough during actuation of the bollard assembly. A first groove 21*a* is formed along wall 3*b* for accommodating a first known hydraulic rod seal 130 or other compliant seal therein. This first seal engages outer bollard tube 11 to provide a seal to prevent moisture from migrating into the bollard assembly interior between access flange 3 and outer tube 11. A second groove 21*b* is formed along wall 3*b* for accommodating a second known hydraulic rod seal 130 or other compliant seal therein. The second seal engages a cover plate 28 (described below) when the cover is positioned and secured within cup flange counterbore 2*a*, to provide a seal for preventing moisture from migrating into the bollard assembly interior between cover 28 and the cup flange wall. Access flange 3 is formed from steel or another suitable metal or metal alloy using known methods.

Also, a third groove 21*g* is formed along a periphery of the access flange for accommodating an O-ring 21*h* or other compliant seal therein. Seal 21*h* engages a wall of cup flange 2 as shown in FIGS. 1, 2, 18, and 19 when the access flange is positioned and secured within cup flange counterbore 2*a*, to provide a seal for preventing moisture from migrating into the bollard assembly interior between access flange 2 and the cup flange wall.

Referring to FIGS. 1, 8, 9, and 18, when bollard assembly 10 is in a retracted configuration, a lock cap 1 is secured over drive head 5 to aid in preventing unauthorized access to the drive nut. As seen in FIGS. 8 and 9, threaded bore 25*b* in drive head housing 25 is located with respect to first through hole 25*c* so as to enable the head of a proprietary bolt 102 screwed into bore 25*b* to cover a portion of lock cap 1 when the lock cap is positioned over drive head 5. This aids in preventing unauthorized removal of lock cap 1 from drive head 5. Bolt 102 has a head designed to accept therein a proprietary tool (not shown) for turning the bolt.

Figure 12:
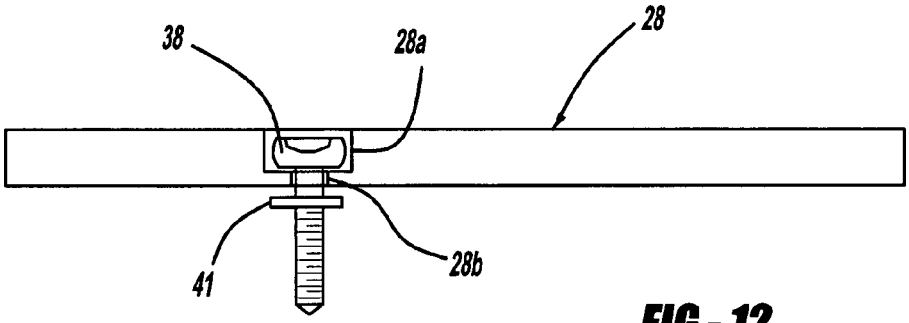
FIG. 12 shows a view of a cover plate mountable in the bollard assembly shown in FIGS. 1 and 2.

Referring again to FIGS. 1, 12, and 19, when bollard assembly 10 is in a retracted configuration, a cover plate 28 is secured within access flange 3 to cover drive head housing 25. Cover plate 28 has one or more counterbores 28*a* and one or more corresponding through holes 28*b* formed therein, each for receiving the shank and head of a proprietary bolt 38. Bolt 38 may incorporate the same proprietary head design as bolt 102 securing lock cap over drive nut, as previously described.

Alternatively, for added security, bolt 38 may have a proprietary head configured for accepting an actuation tool different from the tool used to turn drive head housing bolt 102. Bolt 38 is designed to screw into threaded hole 25*e* in drive head housing, thereby securing the cover plate to the drive head housing. When bolt 38 is installed in cover plate 28, a snap ring 41 is placed along the shank of each bolt, to prevent the bolt from falling our of hole 28*b*. In addition, snap ring 41 is positioned along the shank so as to be spaced apart from the cover plate such that, after the bolt is partially unscrewed from drive head housing 25, the snap ring bears against a bottom face of the cover. This enables the head of bolt 38 to be gripped by a user and pulled upward to remove cover 28 from access flange 3. A counterbore (not shown) may be formed in an underside of cover plate 28 for each bolt 38 to accommodate an associated snap ring 41 therein.

Referring to FIG. 2, a protective sleeve 33 may be placed over extended bollard sections 11 and 12 to provide additional protection to the bollard assembly when extended. Sleeve 33 has a body 33*a* and a flange 33*b* extending from an end of body 33*a*. Flange 33*b* has a plurality of bolt holes (not shown) disposed therealong. A corresponding pattern of threaded bolt holes (not shown) is also formed in an upward-facing surface of drive head housing 25. Sleeve 33 is secured in place with proprietary bolts (not shown) which are threadably received in the drive head housing bolt holes. Also, in an embodiment where the sleeve is to be used, a groove 120 is provided along an upward-facing surface of cup flange 2 for receiving an O-ring 121 or other compliant seal therein. Tightening the proprietary bolts forces protective sleeve flange 33*b* against O-ring 121 in cup flange 2 and shields the bollard assembly interior from adverse weather conditions.

Operation of bollard assembly 10 will now be discussed with reference to the Figures. When it is desired to actuate the bollard assembly, an appropriate tool is used to remove proprietary bolts 38 in cover plate 28, thereby permitting removal of the cover plate. An appropriate proprietary tool is then used to remove bolt 102 from drive head housing 25, thereby enabling grasping and removal of lock cap 1. An appropriate actuation tool is then inserted into drive head 5 to initiate rotation of the shaft in a first direction, to commence extension or raising of the bollard assembly. As threads on shaft 9 engage complementary threads inside threaded nut 7, shaft 9 rises out of stanchion 13. A quantity of lubricant 101 from stanchion 13 (in which shaft 9 has been immersed) adheres to the shaft threads as the shaft rises.

When threads of shaft 9 begin to enter the shaft guide bore second portion S2, lubricant 101 begins to be squeezed into a smaller and smaller volume, between adjacent threads f1 the shaft, and between the shaft and the walls of bore portion S2. When the threads of shaft 9 enter shaft guide bore portion S1, very little clearance is available for lubricant to be squeezed between the outer diameter of threaded shaft 9 and the wall of bore portion S1. This pressurized advancing lubricant mass is now forced upward into threaded bore 23*a* of threaded nut flange 23, and then further upward into lubricant flow passages 7*t*, as the shaft threads continue to advance upward. At the tops of flow passages 7*t*, lubricant enters radial flow channels 7*f* and flows radially outwardly into well 24*f* formed in cap 24. From there, the lubricant flows downward into and along return passages 23*b*, into well 8*d* formed in counterbore 8*b* of the stanchion flange, then into and along shaft guide return passages 27. By this means, the lubricant is recirculated between the threaded nut (where the shaft exits the shaft housing structure) and the lubricant reservoir within the interior of stanchion 13.

As shaft 9 rotates, the shaft rises, lifting inner bollard tube 12 until shoulder 12*c* engages outer bollard shoulder 11*d*. From this point, inner bollard 12 and outer bollard 11 both rise in conjunction with each other. Both bollard tubes 11 and 12 continue to rise as shaft 9 continues to turn, until outer bollard shoulder 11*c* engages access flange 3, as previously described. At this point, both the inner and outer bollard tubes are fully extended and sealed by seals 130.

Retraction of bollard components 10 and 11 is accomplished by rotating drive head 5 in a second direction opposite to the first direction. During retraction of the bollard assembly, sufficient residual lubricant adheres to the shaft threads to facilitate retraction of the shaft back into the stanchion without the application of additional lubricant.

The overlapping of inner bollard tube 12 with outer bollard tube 11, and the overlapping of inner bollard reinforcement with inner bollard tube 12, greatly enhance the strength and impact resistance of the bollard assembly. Low friction components combined with a recirculating lubrication system contribute to long service life. In addition, all bollard components (except for the concrete encased housing) are removable for post-installation servicing.

It will be understood that the foregoing description of the present invention is for illustrative purposes only. As such, the various structural and operational features herein disclosed are susceptible to a number of modifications commensurate with the abilities of one of ordinary skill in the art, none of which departs from the scope of the present invention. Other modifications will be understood in accordance with the contemplated breadth of the present inventions. The preceding description, therefore, is not meant to limit the scope of the invention. Rather, the scope of the invention is to be determined only by the appended claims and their equivalents.

What is claimed is:

1. A telescoping bollard assembly comprising:

a housing;

an outer bollard tube positioned within the housing and structured to move with respect to the housing as the bollard assembly is extended; and an inner bollard tube positioned within and structured to slidably engage the outer bollard tube as the bollard assembly is extended, wherein a portion of the inner bollard tube overlaps a portion of the housing when the bollard assembly fully extended; the assembly further comprising a reinforcing member positioned within the inner bollard tube and structured to move along with the outer tube as the assembly is extended.

2. A telescoping bollard assembly comprising:

an outer bollard tube; and an inner bollard tube positioned within and structured to slidably engage the outer bollard tube as the bollard assembly is extended, the inner and outer bollard tubes being structured such that a portion of the inner bollard tube overlaps a portion of the outer bollard tube when the bollard assembly is fully extended, the assembly further comprising a reinforcing member positioned within the inner bollard tube and structured to move along with the inner tube as the assembly is extended.

3. The bollard assembly of claim 2 wherein the reinforcing member is structured to overlap at least part of a portion of the inner bollard tube overlapped by the outer bollard tube when a portion of the inner bollard tube extends from the housing and a portion of the outer bollard tube extends from the housing so as to overlap a portion of the inner bollard tube.

4. The bollard assembly of claim 2 further comprising a protective sleeve structured for enclosing overlapping portions of the inner and outer bollard tubes when the bollard assembly is fully extended.

* * * * *

UNITED STATES PATENT AND TRADEMARK OFFICE

CERTIFICATE OF CORRECTION

PATENT NO. : 8,794,865 B2
APPLICATION NO. : 11/880758
DATED : August 5, 2014
INVENTOR(S) : Stadler It is certified that error appears in the above-identified patent and that said Letters Patent is hereby corrected as shown below:

In the Specification

Column 2; Line 11; Insert --to-- after access.

Column 2; Line 54; Delete "includes".

Column 6; Line 52; Delete "Threaded" and insert --threaded--.

Column 10; Line 9; Delete "_".

Column 10; Line 13; Delete "1" and insert --11--.

Signed and Sealed this
Fourth Day of November, 2014

Michelle K. Lee

Michelle K. Lee
*Deputy Director of the United States Patent and Trademark Office*